US005628160A

United States Patent [19]

Küng

[11] Patent Number: 5,628,160

[45] Date of Patent: May 13, 1997

[54] ELASTIC FLOORING ELEMENTS

[75] Inventor: Peter Küng, Jona, Switzerland

[73] Assignee: Sportförderung Peter Küng AG, Jona, Switzerland

[21] Appl. No.: 573,275

[22] Filed: Dec. 15, 1995

[30] Foreign Application Priority Data

Dec. 19, 1994 [CH] Switzerland ..... 03824/94

[51] Int. Cl.[6] ..... E04F 11/16; E04F 15/00

[52] U.S. Cl. ..... 52/591.1; 52/177; 52/181; 403/11; 403/294

[58] Field of Search ..... 52/177, 179, 180, 52/181, 591.1; 403/11, 294, 364

[56] References Cited

U.S. PATENT DOCUMENTS

| | | | |
|---|---|---|---|
| 3,438,312 | 4/1969 | Becker et al. | 52/177 X |
| 4,167,599 | 9/1979 | Nissinen | 52/177 X |
| 4,367,615 | 1/1983 | Feldman | 52/591.1 |
| 4,436,779 | 3/1984 | Menconi et al. | 52/177 X |
| 4,468,910 | 9/1984 | Morrison | 52/177 X |
| 4,584,221 | 4/1986 | Küng . | |
| 4,930,286 | 6/1990 | Kotler | 52/177 |
| 5,009,045 | 4/1991 | Yoder | 52/177 |
| 5,076,534 | 12/1991 | Adam | 52/591.1 X |
| 5,323,575 | 6/1994 | Yeh | 52/177 |
| 5,509,244 | 4/1996 | Bentzon | 52/177 X |

FOREIGN PATENT DOCUMENTS 649798 6/1985 Switzerland .

*Primary Examiner*—Wynn E. Wood

*Attorney, Agent, or Firm*—Watson Cole Stevens Davis, P.L.L.C.

[57] ABSTRACT

Elastic elements which can be connected together to form a flooring covering include a rectangular plastic frame, interconnected struts within the frame forming a lattice structure, male couplings in the form of elongated bars extending outwardly of the frame and having end plates, and female couplings in the form of spring latches inside the frame to connect with the elongated bars of adjacent elements. Springs extending outwardly of the frame contact an adjacent element to maintain a predetermined spacing therebetween, while the latches of female couplings contact the stop plates of cooperating male couplings to limit separation of the adjacent elements.

9 Claims, 4 Drawing Sheets

ELASTIC FLOORING ELEMENTS

BACKGROUND OF THE INVENTION

1. Field of the Invention

The invention relates to rectangular elastic elements which can be used in groups to form a floor covering, each element being formed of a single piece of plastic having a skeletal structure formed by a lattice of struts, an external frame and couplings (male and female) for Joining with neighbouring elements.

Plastic elements of this type are disclosed in Swiss Patent No. 649,798. However, it has been found that, due to their construction, they are not easily coupled together or decoupled, and when coupled together to form a floor covering, they tend not to remain flat when exposed to large temperature variations.

It is an object of the present invention to provide elastic plastic flooring elements which can be easily coupled together and decoupled when necessary, and which will remain flat even when exposed to large temperature changes.

SUMMARY OF THE INVENTION

According to this invention each elastic flooring element includes male couplings in the form of elongated bars Jutting out from an external frame parallel to the element surface, and its female couplings, all of which lie inside the external frame, include two spring latches which catch a male bar of an adjacent element from below, on the bottom of the unit and normal to its surface. The elongated bar also has a stop for both latches on its end remote from the external frame.

Further features and advantages of the invention will be understood by reference to the accompanying drawings, taken in conjunction with the following discussion.

DETAILED DESCRIPTION OF THE PREFERRED EMBODIMENT

Figure 1:
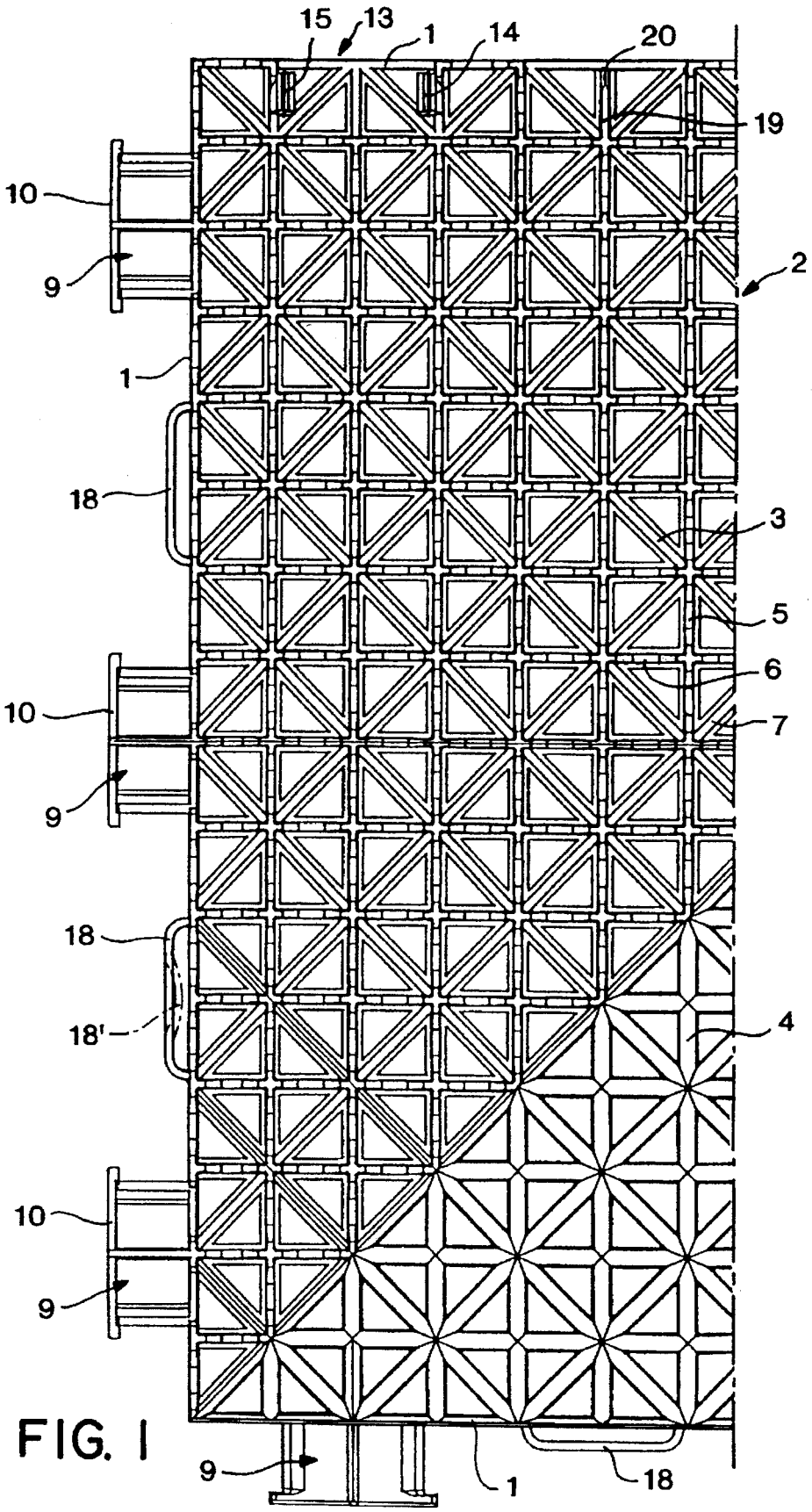
FIG. 1 is a plan view of an element according to the invention, shown in part both from below and above.

FIG. 1 shows a portion of a flooring element according to the invention. It includes a frame 1 and skeletal structure 2. The portion of the skeletal structure seen from below is labeled 3 and the portion seen from above is labeled 4. Each element is in the form of an elastically yielding rectangular or square plate. In practice the element is usually square, so that in FIG. 1 the horizontal and vertical dimensions on the page are the same. The skeletal structure 2 is formed by a lattice of struts shown as ribs 5, 6 and 7, the tops of which are crenated as shown at 8 in FIG. 2 to improve traction. A number of such elements form a floor covering, e.g., for a tennis court.

Figure 4:
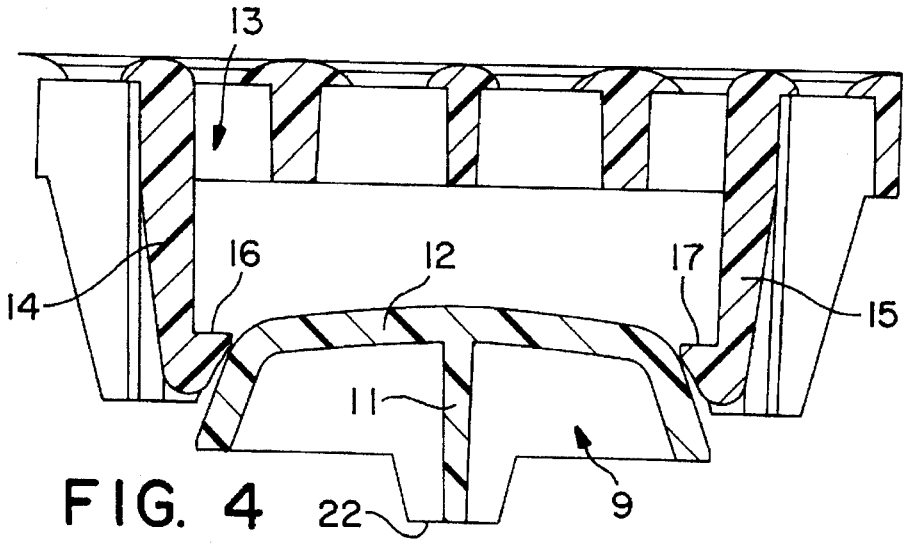
FIG. 4 shows corresponding couplings before coupling.
Figure 5:
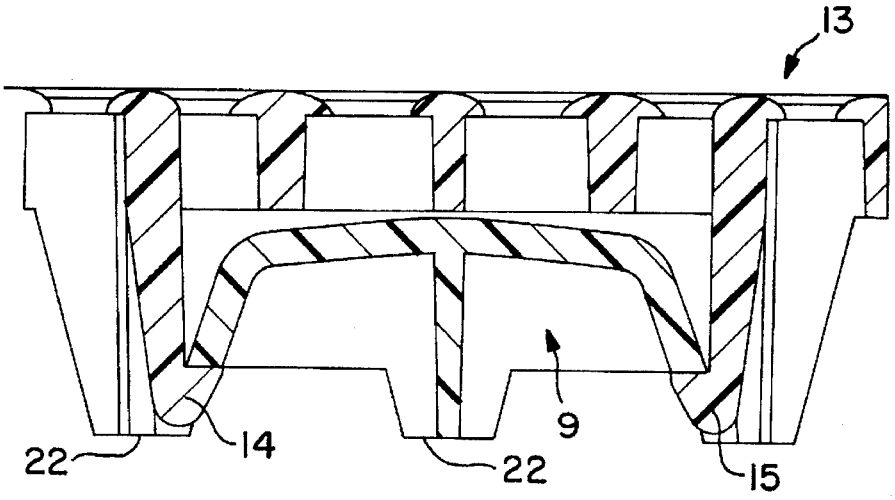
FIG. 5 is of the same cross-section as FIG. 4, but after coupling.
Figure 6:
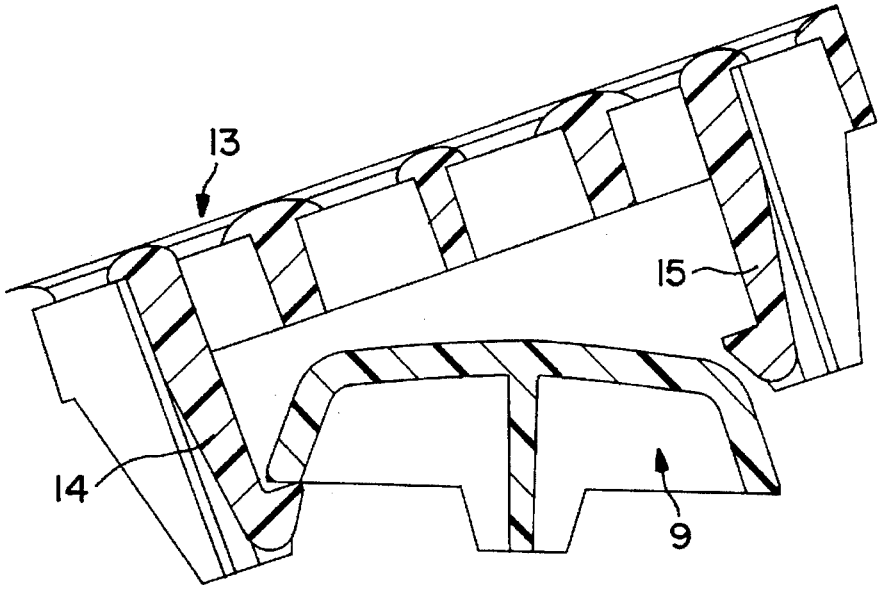
FIG. 6 is the same cross-section as in FIGS. 4 and 5 during decoupling of the two units.

To aid laying and Joining with adjacent elements, the elements are provided with cooperating male and female couplings. Two adjacent sides of the element have three male couplings each, although from FIG. 1 it appears as if only one side has three male couplings 9, while a neighbouring side has a single one. Each male coupling 9 is formed as an elongated bar extending parallel to the element surface and jutting out of the external frame. This bar 9 has a plate 10 at its end remote from the external frame that, as will be explained later, serves as a stop. As seen in FIGS. 4–6, the bar 9 includes a stem 11 and a cross-piece 12, thus giving it a T-shaped cross-section.

Each female coupling 13 is designed to mesh closely with a male coupling 9 so there are equal numbers of male and female couplings on each element. The female couplings 13 are present on the remaining neighbouring sides and can be seen from FIGS. 1, 2 and 3, to lie within the external frame. Female couplings consist of two spring latches 14 and 15, each with support shoulders 16 and 17, respectively, meant for a bar 9 positioned therebetween. When two neighbouring elements are coupled together, the spring latches 14 and 15 grip the bottom of a bar 9 on the bottom of the unit normal to the unit surface (see FIG. 5).

Figure 2:
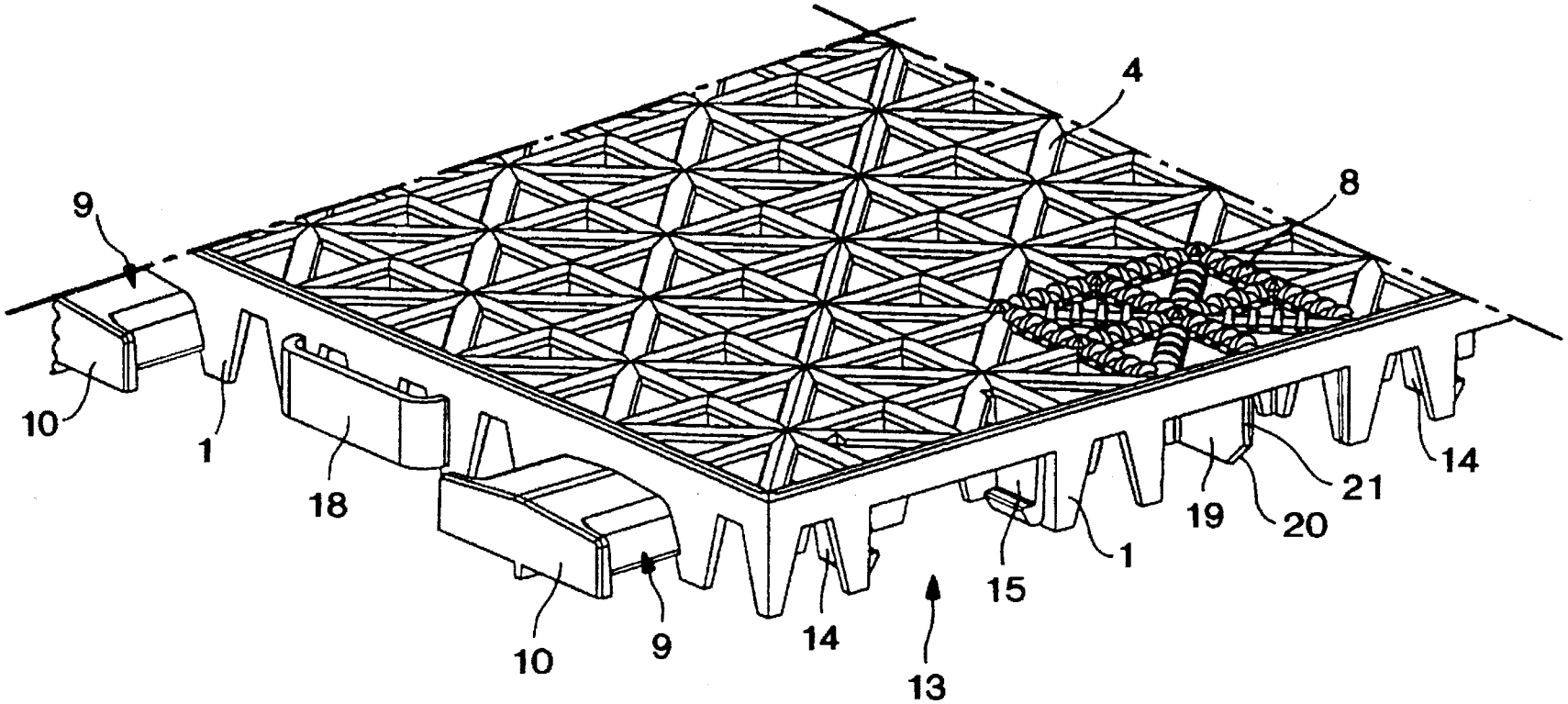
FIG. 2 is a perspective view of a corner of the element seen from above.
Figure 3:
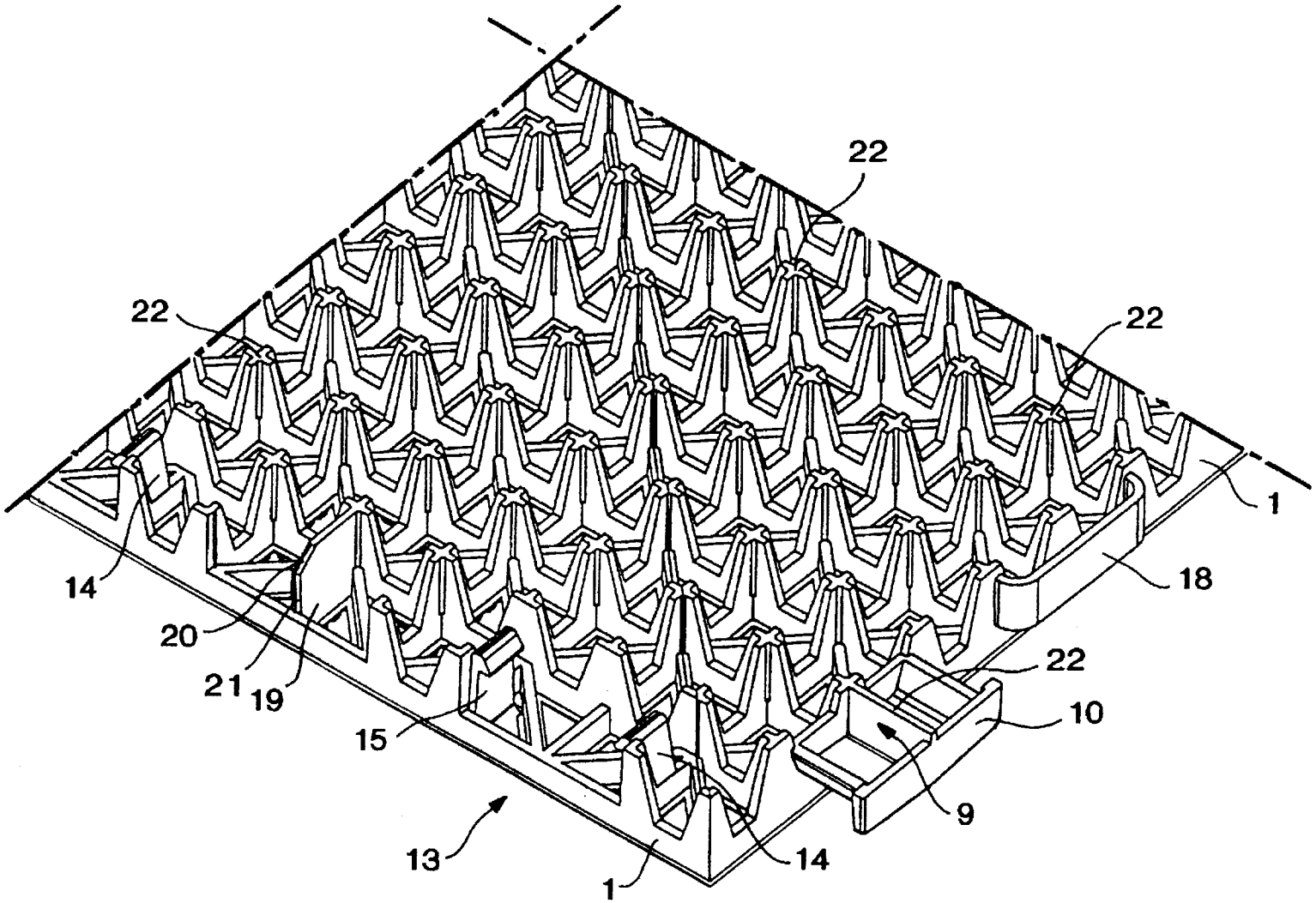
FIG. 3 is a corner of the element, as in FIG. 2, but from below.

From FIGS. 1–3 it is apparent that between every two male couplings there is a leaf spring 18 joined at either end to the external frame. Both are a single piece made from the same plastic. From FIG. 1 every side of the plastic element with three male couplings has two springs 18 in between, including the edge shown horizontally at the bottom of FIG. 1. The function of the two springs on each of the two sides is to press neighbouring elements apart, forming an expansion Joint between neighbouring elements so that even at high temperatures, no crumpling of linked elements occurs. From FIGS. 1–3 it can be seen that the underside of each element is provided with vertical plates 19, each of which has a slanted rise 20. These plates 19 and their rises 20 lie inside the element surface, as do the female couplings, and are always between female couplings 13. Should two neighbouring elements be coupled together, i.e., pressed from the positions in FIG. 4 into that of FIG. 5, the slanted rise 20 will be pressed into the middle area of a spring 18, deforming it into position 18', shown in dotted lines in FIG. 1. This way both coupled elements are pushed so far apart that the latches 14 and 15 of the female coupling 13 lie elastically against the stop 10 of the male coupling 9. When two neighbouring elements are thus bound, instead of the slanted rise 20 resting against the spring in position 18', the connected edge 21 rests against the spring.

The whole element explained thus far is a single piece.

In another embodiment which is not depicted, the springs 18 could be placed on the other two sides of the unit, where the female couplings 13 are, so that there would be a spring 18 between every two female couplings 13.

Several plastic elements can be connected to form a floor covering in the following manner. A plastic element is placed on a base so that surfaces 22, shown in FIG. 3, lie on the base (FIGS. 3 and 4). The neighbouring unit is brought into position with its female coupling 13 as shown in FIG. 4, and pressed down so that both latches 14 and 15 first separate then snap into the position in FIG. 5, gripping the bar 9 from below. This way the male and female couplings of neighbouring elements are joined. Springs 18 ensure that the latches 14 and 15 lie against the end plates 10 so that between neighbouring elements there is a gap of only a few millimeters. This way it is no longer necessary to pull the units apart as they are being laid to create an expansion joint. Once the floor has been laid, any horizontal stresses arising inside the surface of the layer are taken up by the bars 9 and their end plates 10, so that the male couplings 9 are only stressed by pulling forces rather than the bending ones in the case of the element mentioned at the start. It can be seen from the figures that the plastic elements no longer have the pipe structures of the prior art, so dirt does not collect in them. As seen in FIG. 3, the structure of the underside of the element can consist entirely of exterior surfaces, so that after a shower, moisture can be carried away by circulating air relatively quickly. This means that a floor formed by the plastic elements of the invention will dry more quickly after a rain. The solid grip of the latches 14 and 15 on the bar 9 shown in FIG. 5 prevents either side from rearing up, ensuring that the floor covering remains flat. Should it be necessary to remove the floor covering, one side of a flexible unit can be pulled up, as in FIG. 6, so that one latch 15 loses its grip with the bar 9 of the neighbouring unit. The entire bar 9 follows, disengaging the grip of the latches 14 and 15.

I claim:

1. An elastic, one-piece flooring element which comprises a rectangular frame, strut means forming a lattice within said frame, said frame and said strut means defining upper and lower surfaces of said flooring element, male coupling means in the form of elongated bars extending outwardly from at least one side of said rectangular frame, each said elongated bar including a stop means at an end thereof remote from said frame, female coupling means in the form of spaced apart latches located within said frame on a side thereof having no male coupling means, said latches being cooperable with a male coupling means of an adjacent said flooring element to connect said elements together, and spring means extending outwardly of said frame to contact an adjacent said flooring element to maintain a predetermined spacing therebetween.

2. An elastic, one-piece flooring element according to claim 1, wherein each said stop means comprises a plate.

3. An elastic, one-piece flooring element according to claim 1, wherein each elongated bar includes a stem and a cross-piece defining a generally T-shaped cross-section.

4. An elastic, one-piece flooring element according to claim 3, wherein the latches of each female coupling means include facing support shoulders for latching a cross-piece of an elongated bar of an adjacent said flooring element.

5. An elastic, one-piece flooring element according to claim 1, where a said spring means is located between adjacent male coupling means, a stop means of each elongated bar abutting said latches of a female coupling means of an adjacent said flooring element.

6. An elastic, one-piece flooring element according to claim 1, wherein said spring means are one-piece with said frame.

7. An elastic, one-piece flooring element according to claim 1, including plate means within said frame having a slanted side edge facing said frame for abutment against a spring means of an adjacent said flooring element.

8. An elastic, one-piece flooring element according to claim 1, wherein said male coupling means are located along first and second adjacent sides of said frame and said female coupling means are located along third and fourth adjacent sides of said frame.

9. An elastic, one-piece flooring element according to claim 1, wherein said flooring element is made of plastic.

* * * * *